US006171738B1

(12) United States Patent
Takada et al.

(10) Patent No.: US 6,171,738 B1
(45) **Date of Patent: *Jan. 9, 2001**

(54) METHOD OF PREPARING SILVER HALIDE EMULSION

(75) Inventors: Hiroshi Takada; Sadayasu Ishikawa; Satoshi Ito, all of Hino (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/052,728

(22) Filed: Mar. 31, 1998

(30) Foreign Application Priority Data

Apr. 8, 1997 (JP) ..... 9-089355

(51) Int. Cl.[7] ..... G03C 1/015
(52) U.S. Cl. ..... 430/30; 430/569
(58) Field of Search ..... 430/567, 569, 430/30

(56) References Cited

U.S. PATENT DOCUMENTS

| | | | |
|---|---|---|---|
| 4,334,012 | 6/1982 | Mignot | 430/567 |
| 5,270,159 | 12/1993 | Ichikawa et al. | 430/569 |
| 5,362,618 | 11/1994 | Ishikawa et al. | 430/567 |

FOREIGN PATENT DOCUMENTS

| | | | |
|---|---|---|---|
| 0507701 | 7/1992 | (EP) | G03C/1/015 |
| 0577886 | 12/1994 | (EP) | G03C/1/005 |

OTHER PUBLICATIONS

European Search Report EP 98 10 5834.

*Primary Examiner*—Mark F. Huff
(74) *Attorney, Agent, or Firm*—Jordan B. Bierman; Bierman, Muserlian and Lucas

(57) ABSTRACT

A method for preparing a silver halide emulsion is disclosed, wherein the method controls a mean intergrain distance in the process of growing silver halide grains contained in a silver halide emulsion, as defined below, over a period of from the start of growing silver halide grains to completion thereof:

Mean intergrain distance=(Volume of the reaction mixture solution/number of grains in the reaction mixture solution)$^{1/3}$.

11 Claims, 1 Drawing Sheet

METHOD OF PREPARING SILVER HALIDE EMULSION

FIELD OF THE INVENTION

The present invention relates to an apparatus and method for preparing a silver halide emulsion for use in a silver halide light sensitive photographic material, and more specifically, to an apparatus and method for preparing a silver halide emulsion lower in manufacturing cost and with higher sensitivity and superior graininess and pressure resistance.

BACKGROUND OF THE INVENTION

Recently, with the spread of autofocus single-lens reflex cameras and prepackaged single use cameras, photography has become increasingly popular, and silver halide light sensitive photographic materials with expanded functions and lower price are desired. Accordingly, there is needed development of a silver halide photographic emulsion more compatible in manufacturing cost as well as enhanced photographic characteristics such as sensitivity, graininess and sharpness.

Silver halide light sensitive photographic materials are subject to various pressure during the manufacturing process and during their use. Photographic negative films for general use, for example, are often subject to large pressure in the process of cutting and perforating, and are bent or scratched when being transported through the camera. As is well known, when a variety of pressure is applied to the silver halide photographic material, variations of photographic performance result, and a technique of minimizing effects of such pressure is desired.

One of the dominant factors of enhancing sensitivity and image quality of silver halide photographic materials concerns silver halide grains and there has been energetically undergone development of silver halide grains with the aim of improving the sensitivity and image quality. To enhance the image quality, in general, it is effective to increase the number of grains per given silver halide amount by decreasing the grain size, leading to an increase of the number of color-developed points (that is, number of elements). However, a decrease of the grain size results in lowered sensitivity, so that it is limitative to satisfy both high sensitivity and enhanced image quality.

To realize further enhancement of sensitivity and image quality, there has been studied a technique for enhancing the ratio of sensitivity to grain size of each of the silver halide grains; and as one thereof is disclosed a technique of employing tabular silver halide grains in JP-A 58-111935, 58-111936, 58-111937, 58-113927 and 59-99433 (herein, the term "JP-A" refers to an unexamined and published Japanese Patent Application). The tabular silver halide grains each have a larger surface area per volume, as compared to silver halide regular crystal grains such as hexagonal, octahedral or dodecahedral grains, whereby a larger amount of a sensitizing dye can be adsorbed onto the grain surface, leading to enhancement of sensitivity, including an improvement in spectral sensitization efficiency.

Of the techniques for improving silver halide emulsions directed to enhancement of sensitivity and image quality, the most basic and important technique is one of preparing a monodispersed silver halide grain emulsion. Since there is a difference in the conditions for optimal chemical sensitization or spectral sensitization between grains with a larger size and those with a smaller size, it is difficult to undergo optimal chemical sensitization of a silver halide emulsion comprised of both larger grains and smaller grains, that is, an emulsion having a broad grain size distribution, often resulting in an increase of fog density or insufficient chemical sensitization. In the case of a monodispersed silver halide emulsion (with a narrow grain distribution), on the other hand, it is easy to provide an optimal chemical sensitization or spectral sensitization, enabling to prepare a silver halide emulsion with high sensitivity, lower fog and superior graininess.

As techniques for preparing a monodispersed silver halide tabular grain emulsion, JP-A 1-213637 discloses a technique of improving the sensitivity and graininess with monodispersed tabular grains having two parallel twin planes. JP-A 5-173268 and 6-202258 disclose preparation of a silver halide tabular grain emulsion with a narrow grain size distribution. It is noted that the techniques described above are directed to monodispersed silver halide tabular grains in which there is a small fluctuation with respect to the equivalent circular diameter between grains. As is well recognized in the art, the size of the tabular grains can be determined in terms of at least two parameters, that is, one is the equivalent circular diameter of the tabular grain, and the other one is the grain thickness. In other words, even if only the distribution with respect to the equivalent circular diameter of the tabular grains should be narrowed, the distribution of the tabular grains with respect to the grain size can not be narrowed. In cases where the distribution of the tabular grain size is broad, there arise problems such as deterioration of the graininess, due to fluctuations in sensitivity and differences in developability.

JP-A 6-258744 discloses a technique of improving sensitivity, contrast, pressure resistance, latent image stability by using monodispersed silver halide tabular grains having an aspect ratio of 2 or more and containing regions different in the halide composition within the grain, wherein the expression, monodispersed grains means those with a little fluctuation with respect to the equivalent circular diameter of the tabular grains. However, the technique described above does not include any reduction of the cost for manufacturing the silver halide tabular grain emulsion. JP-A 5-210188 discloses preparation of core grains containing 10 to 45 mol % iodide under the condition of maintaining the distance between grains of 0.1 to 3.0 $\mu$m. (Herein, the above-described distance between grains divided by 0.89 is nearly identical to the mean distance between grains defined in the present invention, although both are differently defined.) However, the above technique does not include any intention of arbitrarily controlling the mean distance between grains in the process of grain growth nor concrete means therefor.

JP-A discloses a technique of introducing dislocation lines into tabular silver halide grains to enhance the sensitivity. As is generally known, application of pressure to silver halide grains results in fog or desensitization, and silver halide grains in which dislocation lines are introduced, exhibited marked desensitization when subjected to pressure. JP-A 3-189642 discloses a silver halide emulsion comprised of monodispersed tabular grains having an aspect ratio of 2 or more and dislocation lines of 10 or more in the fringe portions. However, it was proved that marked desensitization due to pressure, resulted from introduction of the dislocation lines, could not improved according to this technique.

In development of silver halide emulsions, an important viewpoint, besides photographic performance is the problem concerning the manufacturing cost. A advantageous method in the manufacturing cost is to increase the manufactured amount of each emulsion batch. In other words, it is to increase the yield of silver halide in a reaction vessel for preparing silver halide emulsion at the time of completion of grain growth. Thus, it is to increase the concentration of silver halide in the emulsion at the time of completion of the grain growth.

JP-B 59-43727 and JP-A 3-140946 disclose a technique of employing ultrafiltration to concentrate the volume of the reaction product (silver halide emulsion) in the process of preparing emulsions (herein, the term JP-B means an examined and published Japanese Patent). However, these disclosures do not suggest anything with respect to preparation of tabular grains, specifically, monodispersed silver halide tabular grain emulsion, nor intend to control a mean intergrain distance in the process of preparing a silver halide emulsion.

JP-A 6-67326 discloses the preparation of a silver halide tabular grain emulsion, in which ultrafiltration is employed to concentrate the volume of reaction products to enhance the yield and obtain tabular grains having medium aspect ratios. According to this disclosure, employing the phenomenon that the aspect ratio of the tabular grains is decreased with concentration, tabular grains having a medium aspect ratio can be obtained by concentrating a reaction mixture containing tabular grains having a high aspect ratio by ultrafiltration during the grain formation. In general, the higher the aspect ratio, the more difficult it is to obtain monodispersed tabular grains. Since it is generally difficult to prepare monodispersed tabular grains having a high aspect ratio, it can not be expected to obtain monodispersed tabular grains having a low aspect ratio by concentrating a high aspect ratio tabular grain emulsion. In fact, silver halide emulsions disclosed therein, which include inventive and comparative emulsions, exhibit a variation coefficient of an equivalent spherical diameter of 0.3 or more, whereby problems regarding to photographic performance of conventional tabular grains cannot be solved. Furthermore, the disclosure teaches nothing with respect to an apparatus for preparing a silver halide emulsion.

SUMMARY OF THE INVENTION

Accordingly, an object of the present invention is to provide a silver halide emulsion with high sensitivity and superior graininess, and improved in the manufacturing cost and pressure resistance and an apparatus and method for preparing tabular grain emulsion having characteristics described above.

The above object of the invention can be accomplished by the following constitution:

(1) An apparatus for preparing a silver halide emulsion by reacting a silver salt and a halide salt in solution, wherein the apparatus has a process condition such that a mean intergrain distance in the process of growing silver halide grains contained in a silver halide emulsion, as defined below is optionally so controlled as to be maintained over a period of from the start of growing silver halide grains to completion thereof:

$$\text{Mean intergrain distance}=(\text{Volume of reaction mixture solution/number of grains in the reaction mixture solution})^{1/3};$$

(2) The apparatus for preparing a silver halide emulsion as described in (1), wherein the mean intergrain distance in the process of growing silver halide grains contained in a silver halide emulsion is so controlled as to be maintained within not less than 0.60 times and not more than 1.15 times that at the start of the grain growth over a period of from the start of growing silver halide grains to completion thereof;

(3) The apparatus for preparing a silver halide emulsion as described in (1) or (2), wherein the volume of a reaction mixture solution in the process of grain growth is controlled and maintained within not less than 0.22 times and not more than 1.52 times that at the start of the grain growth;

(4) The apparatus for preparing a silver halide emulsion as described in (1), (2) or (3), wherein grain growth is performed while optimally withdrawing an aqueous solution containing salts from the reaction mixture solution by ultrafiltration;

(5) The apparatus for preparing a silver halide emulsion as described in any of (1) to (4), wherein a permeating flux of the soluble salt solution separated through the ultrafiltration membrane is optionally controlled;

(6) The apparatus for preparing a silver halide emulsion as described in any of (1) to (5), wherein said silver halide emulsion comprises silver halide grains and a dispersing medium, said silver halide grains having a coefficient of variation of an equivalent spherical diameter of 0.2 or less, and at least 50% of the total projected area of said silver halide grains contained in the emulsion being accounted for by tabular grains having an aspect ratio of 5 or more;

(7) The apparatus for preparing a silver halide emulsion as described in (6), wherein at least 50% of the total projected area of said silver halide grains contained in the emulsion is accounted for by tabular grains having an aspect ratio of 8 or more;

(8) A method for preparing a silver halide emulsion, wherein grain growth is performed by using the preparation apparatus described in (1) to (5).

(9) An apparatus for preparing a silver halide emulsion by reacting a silver salt and a halide salt in solution, comprising reaction vessel, means for introducing a dispersing medium, means for introducing water, means for introducing a silver salt, means for introducing a halide salt and means for draining an aqueous solution and intergrain distance controlling means, wherein the intergrain distance controlling means increases and decreases a mena intergrain distance as defined below in a reaction mixture solution in a reaction vessel by predetermined amount during growth of silver halide grains:

$$\text{Mean intergrain distance}=(\text{Volume of the reaction mixture solution/number of grains in the reaction mixture solution})^{1/3};$$

(10) The apparatus described in (9), wherein the apparatus is provided with a ultrafiltration device;

(11) The apparatus described in (9), wherein the intergrain distance controlling means controls at least one of the water introducing means, the dispersion medium introducing means ot the aqueous solution draining means so that the water or the dispersion medium is to be added at a predetermined variable flow rate, or the or the aqueous solution is to be drained at a predetermined variable flow rate;

(12) The apparatus described in (11), wherein the apparatus further comprises a permeation flux controlling means for controlling the permeation flux of a solution separated through the ultrafiltration device;

(13) The apparatus described in (9), wherein the intergrain distance controlling means controls at least two of the dispersing medium introducing means, the water introducing means, the silver salt introducing means, the halide salt introducing means and the aqueous solution draining means, by means of variable flow rate(s) so that the mean intergrain distance is to be increased and decreased by predetermined amount;

(14) The apparatus described in (13), wherein the intergrain distance controlling means controls at least three of the dispersing medium introducing means, the water introducing means, the silver salt introducing means, the halide salt introducing means and the aqueous solution draining means, by means of variable flow rate(s) so that the mean intergrain distance is to be increased and decreased by predetermined amount;

(15) A method for preparing a silver halide emulsion by reacting a silver salt and a halide salt in solution comprising the steps of:

forming silver halide nucleus grains and silver halide grain growth is allowed to proceed in a reaction vessel in which the nucleus grains and a dispersing medium are present, controlling, during grain growth, at least three variable flow rates for dispersing medium introduction, water introduction, silver salt introduction, halide salt introduction and aqueous solution draining so that a mean intergrain distance as defined below in a reaction mixture is to be increased and decreased by predetermined amount:

Mean intergrain distance=(Volume of the reaction mixture solution/number of grains in the reaction mixture solution)$^{1/3}$

DETAILED DESCRIPTION OF THE INVENTION

Figure 1:
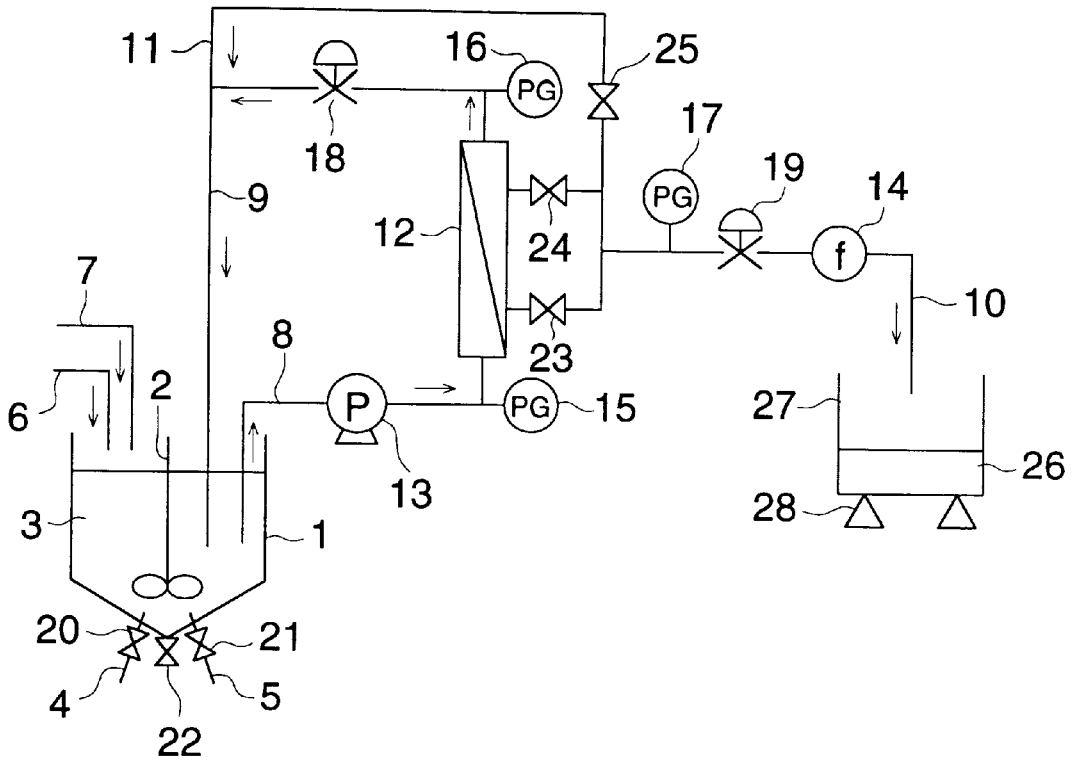
FIG. 1 is a schematic diagram of a preparation apparatus according to the present invention.

The preparation apparatus according to the invention is one capable of preparing a silver halide emulsion, comprising a reaction vessel in which silver halide grains are formed, pipe lines for adding various solutions used for forming silver halide grains and a mechanism for stirring a reaction mixture solution, and further comprising a mechanism for concentrating the reaction solution to control the mean intergrain distance during grain growth. The concentrating mechanism may be provided within the reaction vessel, and is preferably connected to the reaction vessel via pipe(s). The reaction solution is circulated, by means of a mechanism for circulating the reaction solution, between the reaction vessel and circulation mechanism at an arbitrary (controllable) flow rate. The circulating solution can be stopped at an arbitrary time. The apparatus further comprises a means for determining the amount of a salt-containing solution withdrawn from the reaction solution by the concentrating mechanism, and provided with a mechanism for arbitrarily controlling the amount of the solution withdrawn. The apparatus may be optionally provided with other functions.

In general, the process of preparing a silver halide grain emulsion comprises nucleation (comprising formation of nucleus grains and ripening of the nucleus grains), followed by growth of the nucleus grains. Alternatively, previously prepared nucleus grains (or seed grains) may be allowed to grow separately. The grain growth may further be comprised of two or more stages, such as a first growth stage, second growth stage, etc. The growth process of silver halide grains according to the invention include an overall process from after formation of the nucleus grains to the time of completion of the grain growth. The time of starting the grain growth refers to starting point of the grain growth process.

The mean intergrain distance according to the invention refers to a mean value of distances between grains, and specifically a mean value of spatial distances between the centers of gravity of grains in the reaction mixture solution (silver halide emulsion) during the process of preparing a silver halide emulsion. In other words, assuming that all growing grains are equally spaced from each other in the reaction mixture solution, the mean intergrain distance is the edge length of a cube having the same volume as the space occupied by the grain. More specifically, the mean intergrain distance is defined by the following equation:

Mean intergrain distance=(Volume of the reaction mixture solution/number of grains in the reaction mixture solution)$^{1/3}$ In the growth process of silver halide grains, the volume of the reaction mixture solution contained in the reaction vessel is increased along with grain growth mainly by addition of silver and halide salt solutions used for growing grains, resulting in an increase of the mean intergrain distance. In the apparatus for preparing a silver halide emulsion, an increase of the mean intergrain distance along with grain growth is restrained, which enables maintaining a desired mean intergrain distance or reducing it. Herein, the expression, "maintain a desired mean intergrain distance" refers to the state of keeping a specified mean intergrain distance for at least 10 sec.

The mean intergrain distance of silver halide grains at the growth stage is dependent on the volume of the reaction solution (silver halide emulsion) in the process of growing silver halide grains. Taking account of the yield of a silver halide emulsion, the mean intergrain distance is maintained to preferably be 1.15 or less times that at the start of the grain growth. On the other hand, when the mean intergrain distance is decreased in the process of growing tabular silver halide grains, the aspect ratio decreases. Specifically, in cases where the mean intergrain distance is less than 0.6 times that at the start of the grain growth, a marked decrease of the aspect ratio occurs, and an advantageous feature in photographic performance of tabular silver halide grains is lowereded. Thus, the mean intergrain distance in the process of growing silver halide grains according to the invention is preferably within not less than 0.60 times and not more than 1.15 times that at the start of the grain growth, more preferably from 0.60 to 1.10 times and still more preferably from 0.60 to 1.05 times.

The mean intergrain distance at the start of the grain growth is preferably 1.5 $\mu$m or more, more preferably between 1.8 $\mu$m and 4.0 $\mu$m and still more preferably between 2.0 $\mu$m and 3.5 $\mu$m.

Presuming that the number of silver halide grains is substantially unchanged during the grain growth, the mean intergrain distance being within 0.6 to 1.15 times that at the start of growing means that the volume of the reaction solution is maintained, during the grain growth, within 0.22 to 1.52 times that at the start of growing. In other words, the grain growth is undergone with optimally withdrawing a salt containing solution from the reaction solution through an ultrafiltration membrane so that the volume of the reaction solution is not less than 0.22 times and not more than 1.52 times that at the start of growing. Herein, the flow rate of the salt containing solution separated from the reaction solution through an ultrafiltration membrane is denoted as a permeation flux.

The control of the intergrain distance during the growth of silver halide grains according to the invention is intended to both enhance photographic performance of a silver halide emulsion and to enhance yield of the emulsion. Therefore, enhancement of the emulsion yield accompanied with deteriorated photographic performance is not intended. In cases where the mean intergrain distance at the start of growing grains is less than 1.5 μm, a marked decrease of the aspect ratio occurs with concentration, as shown in the inventive emulsion of Examples of JP-A 6-67326, in which the mean intergrain distance is ca. 1.1 μm. Such a decrease of the aspect ratio often results in undesirable photographic performance.

One example of the embodiments of the preparation apparatus of a silver halide emulsion according to the invention, in which the mean intergrain distance can be controlled and maintained during grain growth, will be explained by reference to FIG. 1. The reaction vessel 1 initially contains a dispersing medium 3. The apparatus comprises the reaction vessel 1, which is provided with a silver salt addition line 4 for adding a silver salt aqueous solution (preferably, a silver nitrate aqueous solution) and a halide addition line 5 for adding a halide aqueous solution (preferably, an alkaline metal bromide, iodide or chloride aqueous solution). The apparatus further comprises a dispersing medium addition line 6 for adding a dispersing medium and a water addition line 7 for adding water The reaction vessel is further provided with a mechanism 2 for stirring a dispersing medium and a reaction solution (a mixture of a dispersing medium and silver halide grains). The stirring mechanism may be any of the conventional types. The silver salt solution is added into the reaction vessel through the silver addition line 4 at a flow rate controlled by a silver addition valve 20. The halide solution is added into the reaction vessel through the halide addition line 5 at a flow rate controlled by a halide addition valve 21. The solutions may be added, through the silver addition line 4 and halide addition line 5, onto the surface of the reaction solution and preferably below the surface of the reaction solution, specifically, in the vicinity of the stirring mechanism 2. The stirring mechanism 2 mingles the silver salt and halide solutions with the dispersing medium, enabling it to cause a soluble silver salt to react with a soluble halide to form silver halide.

In the first stage of formation of silver halide i.e. the nucleation stage is formed a dispersion (reaction solution) containing nucleus grains, optionally followed by the ripening stage. Thereafter, addition of the silver salt and halide solutions is further continued, being transferred to the second stage of the silver halide formation i.e. the growth stage, in which additional silver halide, produced as a reaction product deposit onto the nucleus grains to increase the grains in size. In the process of forming grains by adding the silver salt and halide solutions into the reaction vessel according to the invention, a portion of the reaction solution in the reaction vessel is sent by a circulation pump, through a liquid withdrawing line 8, to an ultrafiltration unit 12 and is returned to the reaction vessel through a liquid returning line 9. In this case, a portion of a soluble salt solution contained in the reaction solution is separated through an ultrafiltration unit 12 by adjusting pressure applied to the ultrafiltration unit with a pressure adjusting valve 18 which is provided in the course of the liquid returning line. Thereby, the grain formation with arbitrarily controlling the intergrain distance in the process of grain formation by adding silver salt and halide solutions into the reaction vessel becomes feasible.

When applying this method in the invention, it is preferred that the permeation flow rate of the soluble salt solution separated through the ultrafiltration membrane (i.e. permeation flux; also referred to as ultrafiltration flux) is arbitrarily controlled. For example, the ultrafiltration flux can be arbitrarily controlled using a flow rate-adjusting valve 19 and a pressure gauge 17 provided in the course of a permeating solution drain line 10. In this case, to minimize variation in pressure of the ultrafiltration unit 12, a permeating solution-returning line 11 may be employed by opening a valve 25 provided in the course of the permeating solution-returning line. Or the permeating solution returning line may not be employed by closing the valve 25; it can be selected, depending on the operation conditions (herein 23 and 24 indicate valves). The ultrafiltration flux can be detected by using a flow meter 14 provided in the course of the permeating solution drain line 10, or detected from variation in weight of the permeating solution 26, by using a permeating solution receiving vessel 27 and a balance 28.

In the invention, concentration by means of ultrafiltration may be carried out continuously or intermittently during the course of grain growth. In applying the ultrafiltration in the grain growth process, after circulation of the reaction solution to the ultrafiltration stage is started, the circulation preferably continues at least until completion of the grain formation. Therefore, even when the concentration is interrupted, it is preferred to continue the circulation of the reaction solution to the ultrafiltration unit. This is because of avoiding the difference in grain growth between grains in the reaction vessel and those in the ultrafiltration stage. Further, it is preferred to make the circulating flow rate through the ultrafiltration stage sufficiently high. Concretely, a residence time in the ultrafiltration unit including withdrawing and returning lines of the reaction solution is preferably 30 sec or less, more preferably 15 sec. and still more preferably 10 sec. or less. The volume of the ultrafiltration stage including the solution withdrawing line 8, returning line 9, ultrafiltration unit 12, a circulating pump 13 and pressure gauges 15 and 16 is preferably 30% or less of the volume of the reaction vessel, more preferably 20% or less and still more preferably 10% or less.

Thus, the volume of total silver halide reaction solution can be arbitrarily reduced, during grain formation, by applying the ultrafiltration stage, as described above. In addition, the volume of the silver halide reaction solution can be kept constant at a given value by adding water from an addition line 7.

Ultrafiltration modules and circulating pumps which can be employed in performing the ultrafiltration according to the invention, are not limited, but it is preferable to avoid materials and structure which act on a silver halide emulsion to adversely affect photographic performance. Further, a differential molecular weight of an ultrafiltration membrane used in the ultrafiltration module can be optionally selected. For example, in cases where removing, during grain growth, a dispersing medium such as gelatin contained in a silver halide emulsion or a compound employed in preparation of the grains, there can be selected an ultrafiltration membrane having a molecular weight cut-off more than the molecular weight of the objective material. In cases where such material is not intended to be removed, on the contrary, an ultrafiltration membrane having a lower differential molecular weight than the molecular weight of the material is selected.

The apparatus and method according to the invention is preferably applicable to preparation of a silver halide tabular grain emulsion. Tabular silver halide grains are crystalographically classified as a twinned crystal. The twinned crystal is one having one or more twin planes within the grain. Classification of the twin crystal forms in silver halide grains is detailed in Klein and Moisar, "Photographishe Korrespondents" vol. 99, page 99 and ibid vol. 100, page 57. Tabular grains relating to the invention are those having two or more parallel twin planes with the grain. The twin planes are present in parallel to a plane having the largest area among planes constituting the surface of the tabular grain which is called the major face). The preferred form in the invention is one having two parallel twin planes.

The aspect ratio according to the invention is referred to as a ratio of equivalent circular diameter of the grain to its thickness (i.e. aspect ratio=diameter/thickness). The equivalent circular diameter refers to a circle having an area equal to the projected area when the grain is projected in the direction vertical to the major face. The equivalent spherical diameter refers to a diameter of a sphere having a volume equal to that of the silver halide grain. The grain thickness refers to the thickness in the direction vertical to the major faces and in general, is equal to the distance between the major faces. The grain projected area for calculating the equivalent circular diameter and equivalent spherical diameter and the thickness can be determine according to the following manner. A sample, on a support is prepared by coating latex balls of a known diameter as an internal standard and silver halide grains so that their major faces are oriented in the direction parallel to the support surface. After subjected to shadowing from an angle by carbon vacuum evaporation, a replica sample is prepared according to a conventional replica method. An electron micrograph of the sample is taken and the projected are and thickness of each grain can be determined using an apparatus such as an image processing device. In this case, the grain projected area can be calculated from the projected area of the internal standard and the grain thickness, from shadow lengths of the internal standard and the grain. In the invention, mean values of the aspect ratio, equivalent circular diameter, grain thickness and equivalent spherical diameter each are an arithmetic average of values determined by measuring at least 500 grains contained in the emulsion.

The coefficient of variation of the equivalent spherical diameter of silver halide grains is a value as defined below. The coefficient of variation of the equivalent spherical diameter of silver halide grains according to the invention is preferably 0.2 or less, more preferably 0.15 or less and still more preferably 0.1 or less.

Coefficient of variation of the equivalent spherical diameter=(standard deviation of equivalent spherical diameter)/(mean equivalent spherical diameter).

Similarly can be determined a coefficient of variation of the equivalent circular diameter, as defined below. The coefficient of variation of the equivalent circular diameter of silver halide grain according to the invention is preferably 0.2 or less, more preferably 0.15 or less and still more preferably 0.1 or less.

Coefficient of variation of equivalent circular diameter=(standard deviation of equivalent circular diameter)/(mean equivalent circular diameter)

Preferably at least 50% of the total grain projected area of the emulsion according to the invention is accounted for by tabular grains having an aspect ratio of 5 or more and more preferably at least 50% of the total grain projected area of the emulsion according to the invention is accounted for by tabular grains having an aspect ratio of 8 or more. At least 80% of the total grain projected area of the emulsion according to the invention is preferably accounted for by tabular grains relating to the invention.

The tabular grains relating to the invention each have one or more parallel twin planes within the grain. Preferably at least 50% (more preferably at least 80%) of the tabular grains relating to the invention is accounted for by those having two parallel twin planes within the grain. The twin plane(s) can be observed by transmission electron microscopy, for example, in the following manner. A silver halide emulsion is coated on a support so that the major faces of the grains are oriented in the direction parallel to the support, to form a sample. The sample is repeatedly cut vertically to the support with a diamond cutter to obtain thin slices with a thickness of ca. 0.1 $\mu$m. The presence position of the twin planes can be confirmed by observing the slices with a transmission electron microscope.

The composition of silver halide grains relating to the invention is preferably silver iodobromide, silver bromide, silver chlorobromide, or silver iodochlorobromide. Of these is preferably silver iodobromide grain emulsion having an average iodide content of 10 mol % or less, more preferably 1 to 10 mol %, and 1 to 6 mol %. The halide composition of silver halide grains can be determined in EPMA method or X-ray diffraction analysis.

An average iodide content of the surface phase of silver halide grains relating to the invention is preferably 1 mol % or more, more preferably 2 to 20 mol % and still more preferably 3 to 15 mol %. The average iodide content of the surface phase of silver halide grains is one determined by the XPS method or ISS method. The surface iodide content is determined, for example, by the XPS method, as follows. A sample is cooled to −155° C. or lower under ultra-high vacuum at $1\times10^{-4}$ torr or less, exposed to Mg Ka line as probe X-rays at a source current of 40 mA, and measurement is made with respect to Ag 3d5/2, and Br 3d, and I 3d3/2 electrons. Integral intensities of measured peaks are corrected with a sensitivity factor and from these intensities can be determined the composition such as an iodide content of the silver halide surface phase.

In a silver halide emulsion relating to the invention, distribution of the iodide content among grains is preferably more uniform. Thus, a coefficient of variation of the iodide content of grains of the silver halide emulsion is preferably 30% or less and more preferably 20% or less, wherein the coefficient of variation of the iodide content of grains is a standard deviation of the iodide content divided by a mean iodide content time 100(%) and can be obtained by measuring at least 500 grains contained in the silver halide emulsion.

Silver halide grains for photographic use are microcrustals comprised of silver chloride, silver bromide, silver iodide or solid solution thereof. Two or more phases different in halide composition may be formed inside the crystal. As grains having such a structure are known grains comprised of an internal phase and an external phase which are different in halide composition, generally called core/shell type grains. Silver halide grains relating to the invention are preferably those having a core/shell structure in which the internal phase contains iodide hither than the external phase.

The silver halide grains relating to the invention can contain dislocation lines. The preferred location of the dislocation lines is in the vicinity of peripheral portions, edges or corners of tabular grains. The dislocation lines are introduced preferably after 50% of the total silver, more preferably between 60% and 95%, and still more preferably between 70% and 90%.

A method for introducing the dislocation lines into the silver halide grain is optional. The dislocation lines can be introduced by various methods, in which, at a desired position of introducing the dislocation lines during the course of forming silver halide grains, an iodide (e.g., potassium iodide) aqueous solution are added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed. Among these, it is preferable to add iodide and silver salt solutions by a double jet technique, or to add silver iodide fine grains or an iodide ion releasing compound, as an iodide source.

Efficiency of introducing the dislocation lines into silver halide emulsion grains can be enhanced by using the preparation apparatus according to the invention. For example, the mean intergrain distance at the time of introducing the dilocation lines into the grains is controlled to be preferably within not less than 0.60 times and not more than 1.15 times that at the start of the grain growth and more preferably from 0.60 to 0.80 times that at the start of the grain growth. More concretely, the mean intergrain distance at the time of introducing the dilocationlines into the grains is controlled to be preferably not more than 3.2 $\mu$m, more preferably not more than 2.8 $\mu$m and still more preferably not less than 0.9 $\mu$m and not more than 2.0 $\mu$m.

The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are placed on a mesh for electron microscopy. The sample is observed by transmission electron microscopy, while being cooled to prevent the grain from being damaged (e.g., printing-out) by electron beam. Since electron beam penetration is hampered as the grain thickness increases, sharper observations are obtained when using an electron microscope of high voltage type. From the thus-obtained electron micrograph can be determined the position and number of the dislocation lines in each grain.

To the preparation of the silver halide emulsion relating to the invention can be optimally applied a variety of the methods known in the art, including the controlled double jet method and controlled triple jet methods, in which the pAg of the reaction solution is controlled during the course of the grain formation. There can be optionally employed a silver halide solvent, including ammonia, thioethers and thioureas. The thioureas are referred to U.S. Pat. Nos. 3,271,151, 3,790,387 and 3,574,626. Further, the silver halide emulsion can be prepared in an ammoniacal precipitation, neutral precipitation or acidic precipitation. The emulsion is preferably formed under environment at a pH of 5.5 or less, and more preferably 4.5 or less, in terms of restraining fog during the grain formation.

The silver halide emulsion relating to the invention contains a dispersing medium with silver halide grains. The dispersing medium is a compound having protective colloidal property to silver halide grains. It is preferred to cause the dispersing medium to be present over a period from nucleation until completion of the grain growth. Examples of the preferred dispersing medium used in the invention include gelatin and protective colloidal polymers. Preferred gelatin includes alkali-processed or acid-processed gelatin conventionally having a molecular weight of ca. 100,000, low molecular weight gelatin with a molecular weight of 5,000 to 30,000 and oxidized gelatin. Oxidized gelatin, low molecular weight gelatin and oxidized low molecular weight gelatin are preferably employed specifically in the nucleation stage.

To precisely control the halide composition within a grain or among grains, at least one portion of an iodide containing phase of the grain can be formed by supplying iodide containing silver halide fine grains. Similarly at least one portion of an iodide containing phase of the grain can be formed in the presence of silver halide grains having a solubility lower than that the grain. The silver halide grains having a lower solubility is preferably silver iodide fine grains.

An equivalent spherical diameter of silver halide grains relation to the invention is preferably 1.2 $\mu$m or less, and more preferably 0.1 to 0.8 $\mu$m. In the case of less than 0.1 $\mu$m, it is insufficient to achieve sensitivity acceptable in practice. The grain size of more than 1.2 $\mu$m results in deterioration in graininess of the photographic image.

To silver halide emulsions relating to the invention are applicable techniques described in Research Disclosure No. 308119 (herein after, denoted as RD 308119), as shown below.

| Item | RD 308119 |
|---|---|
| Iodide Composition | 993, I-A |
| Preparation Method | 993, I-A, 994 E |
| Crystal Habit (Regular crystal) | 993, I-A |
| Crystal Habit (irregular crystal) | 993, I-A |
| Epitaxial | 993, I-A |
| Halide Composition (Uniform) | 993, I-B |
| Halide Composition (Non-uniform) | 993, I-B |
| Halide Conversion | 994, I-C |
| Halide Substitution | 994, I-C |
| Metal Occlusion | 994, I-D |
| Monodisperse | 995, I-F |
| Solvent Addition | 995, I-F |
| Latent Image Formation (Surface) | 995, I-G |
| Latent Image Formation (Internal) | 995, I-G |
| Photographic Material (negative) | 995, I-H |
| Photographic Material (positive) | 995, I-H |
| Emulsion Blend | 995, I-I |
| Emulsion Washing | 995, II-A |

The silver halide emulsion relating to the invention can be subjected to physical ripening, chemical ripening and spectral sensitization, according to the procedure known in the art. Additives used therein are described in RD 17643, RD 18716 and RD 308119, as shown below.

| Item | RD-308, 119 | RD-17, 643 | RD-18, 716 |
|---|---|---|---|
| Chemical Sensitizer | 996, III-A | 23 | 648 |
| Spectral Sensitizer | 996, IV-A-A, B, C, D, H, I, J | 23–24 | 648–9 |
| Super Sensitizer | 996, IV-A-E | 23–24 | 648–9 |
| Anti-Foggant | 998, IV | 24–25 | 649 |
| Stabilizer | 998, IV | 24–25 | 649 |

Photographic additives usable in the invention are also described in the above-described Research Disclosures, as shown below.

| Item | RD-308, 119 | RD-17, 643 | RD-18, 716 |
|---|---|---|---|
| Anti-staining Agent | 1002, VII-I | 25 | 650 |
| Dye Image-Stabilizer | 1001, VII-J | 25 | |
| Whitening Agent | 998, V | 24 | |
| U.V. Absorbent | 1003, VIIIC, XIII-C | 25–26 | |
| Light Absorbent | 1003, VIII | 25–26 | |

-continued

| Item | RD-308, 119 | RD-17, 643 | RD-18, 716 |
|---|---|---|---|
| light-Scattering Agent | 1003, VIII | | |
| Filter Dye | 1003, VIII | | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant; | 1005, XI | 26–27 | 650 |
| Matting Agent | 1007, XVI | | |
| Developing Agent | 1011, XXB | | |

A variety of couplers can be employed in the invention, exemplary examples thereof are described in the Research Disclosures, as shown below.

| Item | RD 308119 | RD17643 |
|---|---|---|
| Yellow Coupler | 1001, VII-D | 25, VII-C~G |
| Magenta Coupler | 1001, VII-D | 25, VII-C~G |
| Cyan Coupler | 1001, VII-D | 25, VII-C~G |
| Colored Coupler | 1002, VII-G | 25, VII-G |
| DIR Coupler | 1002, VII-F | 25, VII-F |
| BAR Coupler | 1002, VII-F | |
| PUG Releasing Coupler | 1001, VII-F | |
| Alkaline-soluble Coupler | 1001, VII-E | |

The additives used in the invention can be added by the dispersing method described in RD 308119 XIV. There are employed supports described in RD 17643 page 28, RD 18716 pages 647–8 and RD 308119 XIX. The photographic material relating to the invention may be provided with an auxiliary layer such as a filter layer or interlayer, as described in RD 308119 VII-K, and may have a layer arrangement, such as normal layer order, reversed layer order or unit constitution.

The present invention can be applied to a variety of color photographic materials, including a color negative film for general use or cine use, color reversal film for slide or television, color paper, color positive film, and color reversal paper. The photographic materials relating to the invention can be processed according to the method described in RD 176, page 28–29, RD 187166, page 47 and RD 308119, XIX.

EXAMPLES

Embodiments of the present invention will be explained based on examples, but the invention is not limited to these examples.

The following emulsions were prepared using a reaction vessel with a volume of 32 liters, an ultrafiltration unit, SIP-1013 produced by Asahi Kasei and a circulation pump, DAIDO Rotary Pump. The volume of an emulsion circulation portion in the ultrafiltration unit was 1.2 liters and the emulsion was circulated at a rate of 15 l/min. Accordingly, the residence time of the reaction mixture solution was 4.8 sec. and the volume of a emulsion circulation portion in the process of ultrafiltration was 3.8% of the volume of the reaction vessel. The intergrain distance during the growth stage was controlled by controlling a permeating flux in the ultrafiltration unit, concretely, by adjusting a flow rate-adjusting valve 19, as shown in FIG. 1.

Preparation of Emulsion (Em-100)

Nucleation Stage

A gelatin solution B-101 was maintained at 30° C. in a reaction vessel with stirring at a speed of 400 r.p.m. by use of a stirring mixer described in JP-A 62-160128, the pH was adjusted to 1.96 with a 1N sulfuric acid solution, and thereto were added solutions S-101 and X-101 for 1 min. by the double jet addition to form nucleus grains.

B-101

| | |
|---|---|
| Low molecular weight gelatin (Av. M.W. 20,000) | 32.4 g |
| Potassium bromide | 9.92 g |
| $H_2O$ | 12938.0 g |

S-101

| | |
|---|---|
| Silver nitrate | 50.43 g |
| $H_2O$ | 225.9 ml |

X-101

| | |
|---|---|
| Potassium bromide | 35.33 g |
| $H_2O$ | 224.7 ml |

Ripening Stage

After completing the addition, the following solution G-101 was added and the temperature was raised to 60° C. in 30 min., then the pH was adjusted to 5.8 with a 1N potassium hydroxide solution and the reaction mixer was maintained further for 20 min, while keeping a silver potential of 14 mV (measured with a silver ion selection electrode versus a saturated silver-silver chloride electrode, as a reference electrode) using a 1N potassium bromide solution.

G-101

| | |
|---|---|
| Alkali-processed inert gelatin (Av. M.W. 100,000) | 139.1 g |
| Compound A (10 wt. % methanol solution) | 4.64 ml |
| $H_2O$ | 3266 ml |

Compound A: $HO(CH_2CH_2O)_m[CH(CH_3)CH_2O]_{19.8}(CH_2CH_2O)_nH$ (m+n=9.77)

Growth Stage-1

After completing the ripening, solutions S-102 and X-102 were added by the double jet addition at an accelerated flow rate (12 times faster at the end than at the start) for 38 min. After completing the addition was added solution G-102, and after adjusting the stirring speed to 550 r.p.m., solutions S-103 and X-103 were added by the double jet addition at an accelerated flow rate (2 times faster at the end than at the start) for 40 min, while the silver potential was kept at 14 mV using a 1N potassium bromide solution.

S-102

| | |
|---|---|
| Silver nitrate | 639.8 g |
| $H_2O$ | 2866.2 ml |

X-102

| | |
|---|---|
| Potassium bromide | 448.3 g |
| $H_2O$ | 2850.7 ml |

G-102

| | |
|---|---|
| Alkali-processed inert gelatin (Av. M.W. 100,000) | 203.4 g |
| Compound A (10 wt. % methanol solution) | 6.20 ml |
| $H_2O$ | 1867 ml |

S-103

| | |
|---|---|
| Silver nitrate | 989.8 g |
| $H_2O$ | 1437.2 ml |

X-103

| | |
|---|---|
| Potassium bromide | 679.6 g |
| Potassium iodide | 19.35 g |
| $H_2O$ | 1412.0 ml |

Growth Stage-2 (Forming Dislocation Lines)

After completing the addition, the temperature in the reaction vessel was lowered to 40° C. in 20 min. Thereafter, the silver potential was adjusted to −32 mV with a 3.5N potassium bromide solution, then a AgI fine grain emulsion with a mean grain size of 0.05 $\mu$m and of 0.283 moles, based on silver was added thereto, and solutions S-104 and X-104 were added at an accelerated flow rate (1.2 time faster at the end than at the start) for 7 min.

S-104

| | |
|---|---|
| Silver nitrate | 672.0 g |
| $H_2O$ | 975.8 ml |

X-104

| | |
|---|---|
| Potassium bromide | 470.8 g |
| $H_2O$ | 959.4 ml |

In the above emulsion making, the maximum amount of a reaction mixture solution within the reaction vessel was 28.9 liters. Accordingly, an emulsion of 0.49 moles, based on silver, per unit volume (l) of the reaction vessel can be prepared. Thus, a maximum of the emulsion corresponding to (0.49 mole/l)×(32 l), based on silver, can be prepared. After completing the growth, the resulting emulsion was subjected to desalting according to the conventional procedure, redispersed adding gelatin, and the pH and pAg was adjusted to 5.8 and 8.1 at 40° C., respectively. Thus, Emulsion, Em-100 was obtained.

Preparation of Emulsion (Em-200)

Emulsion Em-200 was prepared in a manner similar to Em-100, except for the following stages.

Ripening Stage

After completing the nucleation stage, solution G-101 was added thereto, the temperature was raised to 60° C. in 30 min. and the reaction mixture was further maintained for 20 min. Subsequently, after adjusting the pH to 9.3 with ammonia water and maintaining further for 7 min., the pH was lowered to 5.8. During this stage, the silver potential was maintained at 10 mV using a 1N potassium bromide solution.

Growth Stage-1

After completing the ripening, solutions S-102 and X-102 were added by the double jet addition at an accelerated flow rate (12 times faster at the end than at the start) for 38 min. After completing the addition was added solution G-102, and after adjusting the stirring speed to 550 r.p.m., solutions S-103 and X-103 were added by the double jet addition at an accelerated flow rate (2 times faster at the end than at the start) for 40 min, while the silver potential was kept at 11 mV using a 1N potassium bromide solution.

In the above emulsion making (Em-200), a maximum amount of a reaction solution within the reaction vessel was 29.3 liters. Accordingly, an emulsion of 0.48 moles, based on silver, per unit volume (liter) of the reaction vessel can be prepared. Thus, a maximum of the emulsion corresponding to (0.48 mole/l)×(32 l), based on silver, can be prepared.

Preparation of Emulsion (Em-300)

Using a preparation apparatus of a silver halide emulsion as illustrated in FIG. 1, a silver halide emulsion was prepared according to the following procedure.

Nucleation Stage

A gelatin solution B-101 was maintained at 30° C. in a reaction vessel with stirring at a speed of 400 r.p.m. by use of a stirring mixer described in JP-A 62-160128, the pH was adjusted to 1.96 with a 1N sulfuric acid solution, and thereto were added solutions S-301 and X-301 for 1 min. by the double jet addition at a constant flow rate to form nucleus grains.

B-301

| | |
|---|---|
| Low molecular weight gelatin (Av. M.W. 20,000) | 32.4 g |
| Potassium bromide | 9.92 g |
| $H_2O$ | 12938.0 ml |

S-301

| | |
|---|---|
| Silver nitrate | 50.43 g |
| $H_2O$ | 225.9 ml |

X-301

| | |
|---|---|
| Potassium bromide | 35.33 g |
| $H_2O$ | 224.7 ml |

Ripening Stage

After completing the nucleation stage, solution G-301 was added thereto, the temperature was raised to 60° C. in 30 min. and the reaction mixture was further maintained for 20 min. Subsequently, after adjusting the pH to 9.3 with ammonia water and maintaining further for 7 min., the pH was lowered to 5.8. During this stage, the silver potential was maintained at 8 mV using a 1N potassium bromide solution.

G-301

| | |
|---|---|
| Alkali-processed inert gelatin (Av. M.W. 100,000) | 139.1 g |
| Compound A (10 wt. % methanol solution) | 4.64 ml |
| $H_2O$ | 3266 ml |

Growth Stage-1

After completing the ripening, solutions S-302 and X-302 were added by the double jet addition at an accelerated flow rate (12 times faster at the end than at the start) for 38 min, while the silver potential was kept at 6 mV using a 1N potassium bromide solution. After completing the addition was added solution G-302, and after adjusting the stirring speed to 550 r.p.m., solutions S-303 and X-303 were added by the double jet addition at an accelerated flow rate (2 times faster at the end than at the start) for 40 min, while the silver potential was varied from 8 mV to 4 mV using a 1N potassium bromide solution. Simultaneously with the addition of solutions S-302 and X-302, the reaction solution in the reaction vessel was circulated to an ultrafiltration unit to undergo concentration. As a result, the mean intergrain distance retained, over a period of the growth stage-1, the mean intergrain distance at the start of the growth.

S-302

| | |
|---|---|
| Silver nitrate | 639.8 g |
| $H_2O$ | 2866.2 ml |

X-302

| | |
|---|---|
| Potassium bromide | 448.3 g |
| $H_2O$ | 2850.7 ml |

G-302

| | |
|---|---|
| Alkali-processed inert gelatin (Av. M.W. 100,000) | 203.4 g |
| Compound A (10 wt. % methanol solution) | 6.20 ml |
| $H_2O$ | 1867 ml |

S-303

| | |
|---|---|
| Silver nitrate | 989.8 g |
| $H_2O$ | 1437.2 ml |

X-303

| | |
|---|---|
| Potassium bromide | 679.6 g |
| Potassium iodide | 19.35 g |
| $H_2O$ | 1412.0 ml |

Growth Stage-2

After completing the addition, the temperature in the reaction vessel was lowered to 40°C. in 20 min. Thereafter, the silver potential was adjusted to −32 mV with a 3.5N potassium bromide solution, then a AgI fine grain emulsion with a mean grain size of 0.05 $\mu$m and of 0.283 moles, based on silver, was added thereto, and solutions S-304 and X-304 were added at an accelerated flow rate (1.2 time faster at the end than at the start) for 7 min. After completing concentration in the growth stage-1 and until completing the growth stage-2, circulation of the reaction solution to the ultrafiltration unit was continued.

S-304

| | |
|---|---|
| Silver nitrate | 672.0 g |
| $H_2O$ | 975.8 ml |

X-304

| | |
|---|---|
| Potassium bromide | 470.8 g |
| $H_2O$ | 959.4 ml |

In the above emulsion making, a maximum amount of the reaction solution within the reaction vessel was 20.3 liters. Accordingly, an emulsion of 0.70 moles, based on silver, per unit volume (l) of the reaction vessel can be prepared. Thus, a maximum of the emulsion corresponding to (0.70 mole/l)×(32 l), based on silver, can be prepared. After completing the growth, the resulting emulsion was subjected to desalting according to the conventional procedure, redispersed adding gelatin, and the pH and pAg was adjusted to 5.8 and 8.1 at 40° C., respectively. Thus, Emulsion, Em-300 was obtained.

Preparation of Emulsion (Em-400)

Emulsion Em-400 was prepared in a manner similar to Em-300, except for the following stages.

Ripening Stage

After completing the nucleation stage, solution G-301 was added thereto, the temperature was raised to 60° C. in 30 min. and the reaction mixture was further maintained for 20 min. Subsequently, after adjusting the pH to 9.3 with ammonia water and maintaining further for 7 min., the pH was lowered to 5.8. Meanwhile, the silver potential was maintained at 14 mV using a 1N potassium bromide solution.

Growth Stage-1

After completing the ripening, solutions S-302 and X-302 were added by the double jet addition at an accelerated flow rate (12 times faster at the end than at the start) for 38 min, while the silver potential was hold at 6 mV using a IN potassium bromide solution. After completing the addition was added solution G-302, and after adjusting the stirring speed to 550 r.p.m., solutions S-303 and X-303 were added by the double jet addition at an accelerated flow rate (2 times faster at the end than at the start) for 40 min, while the silver potential was kept at 14 mV using a 1N potassium bromide solution. Simultaneously with the addition of solutions S-302 and X-302, the reaction solution in the reaction vessel was circulated to an ultrafiltration unit to undergo concentration. As a result, the mean intergrain distance retained, for overall period of the growth stage-1, the mean intergrain distance at the start of the growth.

In the above emulsion making (Em-400), a maximum amount of a reaction solution within the reaction vessel was 20.3 liters. Accordingly, an emulsion of 0.70 moles, based on silver, per unit volume (liter) of the reaction vessel can be prepared. Thus, a maximum of the emulsion corresponding to (0.70 mole/l) x (32 l), based on silver, can be prepared.

Preparation of Emulsion (Em-500)

Using a preparation apparatus of a silver halide emulsion as illustrated in FIG. 1, a silver halide emulsion was prepared according to the following procedure.

Nucleation Stage

A gelatin solution B-501 was maintained at 30° C. in a reaction vessel with stirring at a speed of 400 r.p.m. by use of a stirring mixer described in JP-A 62-160128, the pH was adjusted to 1.96 with a 1N sulfuric acid solution, and thereto were added solutions S-501 and X-501 for 1 min. by the double jet addition at a constant flow rate to form nucleus grains.

B-501

| | |
|---|---|
| Oxidized gelatin (Av. M.W. 100,000) | 32.4 g |
| Potassium bromide | 9.92 g |
| $H_2O$ | 12938.0 ml |

S-501

| | |
|---|---|
| Silver nitrate | 50.43 g |
| $H_2O$ | 225.9 ml |

X-501

| | |
|---|---|
| Potassium bromide | 35.33 g |
| $H_2O$ | 224.7 ml |

Ripening Stage

After completing the nucleation stage, solution G-501 was added thereto, the temperature was raised to 60° C. in 30 min. and the reaction mixture was further maintained for 20 min. Subsequently, after adjusting the pH to 9.3 with ammonia water and maintaining further for 7 min., the pH was lowered to 5.8. The silver potential was, meanwhile, maintained at 8 mV using a 1N potassium bromide solution.

G-501

| | |
|---|---|
| Alkali-processed inert gelatin (Av. M.W. 100,000) | 139.1 g |
| Compound A (10 wt. % methanol solution) | 4.64 ml |
| $H_2O$ | 3266 ml |

Growth Stage-1

After completing the ripening, solutions S-502 and X-502 were added by the double jet addition at an accelerated flow rate (12 times faster at the end than at the start) for 38 min, while the silver potential was kept at 6 mV using a 1N potassium bromide solution. After completing the addition was added solution G-502, and after adjusting the stirring speed to 550 r.p.m., solutions S-503 and X-503 were added by the double jet addition at an accelerated flow rate (2 times faster at the end than at the start) for 40 min, while the silver potential was continuously varied from 4 mV to −2 mV using a 1N potassium bromide solution. Simultaneously with the addition of solutions S-502 and X-502, the reaction solution in the reaction vessel was circulated to an ultrafiltration unit to undergo concentration. As a result, the mean intergrain distance retained, over a period of the growth stage-1, the mean intergrain distance at the start of the growth.

S-502

| | |
|---|---|
| Silver nitrate | 639.8 g |
| $H_2O$ | 2866.2 ml |

X-502

| | |
|---|---|
| Potassium bromide | 448.3 g |
| $H_2O$ | 2850.7 ml |

G-502

| | |
|---|---|
| Alkali-processed inert gelatin (Av. M.W. 100,000) | 203.4 g |
| Compound A (10 wt. % methanol solution) | 6.20 ml |
| $H_2O$ | 1867 ml |

S-503

| | |
|---|---|
| Silver nitrate | 989.8 g |
| $H_2O$ | 1437.2 ml |

X-503

| | |
|---|---|
| Potassium bromide | 679.6 g |
| Potassium iodide | 19.35 g |
| $H_2O$ | 1412.0 ml |

Growth Stage-2

After completing the addition, the temperature in the reaction vessel was lowered to 40° C. in 20 min. Thereafter, the silver potential was adjusted to −52 mV with a 3.5N potassium bromide solution, then a AgI fine grain emulsion with a mean grain size of 0.05 $\mu$m and of 0.283 moles, based on silver, was added thereto, and solutions S-504 and X-504 were added at an accelerated flow rate (1.2 time faster at the end than at the start) for 7 min. After completing concentration in the growth stage-1 and until completing the growth stage-2, circulation of the reaction solution to the ultrafiltration unit was continued.

S-504

| | |
|---|---|
| Silver nitrate | 672.0 g |
| $H_2O$ | 975.8 ml |

X-504

| | |
|---|---|
| Potassium bromide | 470.8 g |
| $H_2O$ | 959.4 ml |

In the above emulsion making, a maximum amount of the reaction solution within the reaction vessel was 20.3 liters. Accordingly, an emulsion of 0.70 moles, based on silver, per unit volume (l) of the reaction vessel can be prepared. Thus, a maximum of the emulsion corresponding to (0.70 mole/l)×(32 l), based on silver, can be prepared. After completing the growth, the resulting emulsion was subjected to desalting according to the conventional procedure, redispersed adding gelatin, and the pH and pAg was adjusted to 5.8 and 8.1 at 40° C., respectively. Thus, Emulsion, Em-500 was obtained.

Preparation of Emulsion (Em-600)

Emulsion Em-600 was prepared in a manner similar to Em-500, except for the following stages.

Growth Stage-1

After completing the ripening, solutions S-502 and X-502 were added by the double jet addition at an accelerated flow rate (12 times faster at the end than at the start) for 38 min, while the silver potential was kept at 6 mV using a 1N potassium bromide solution. After completing the addition was added solution G-502, and after adjusting the stirring speed to 550 r.p.m., solutions S-503 and X-503 were added by the double jet addition at an accelerated flow rate (2 times faster at the end than at the start) for 40 min, while the silver potential was continuously varied from 4 mV to −2 mV using a 1N potassium bromide solution. Simultaneously with the addition of solutions S-502 and X-502, the reaction solution in the reaction vessel was circulated to an ultrafiltration unit to undergo concentration. As a result, the mean intergrain distance retained, over a period of the growth stage-1, the mean intergrain distance at the start of the growth.

Growth Stage-2

After completing the addition, the temperature in the reaction vessel was lowered to 40° C. in 20 min. Thereafter, the silver potential was adjusted to −32 mV with a 3.5N potassium bromide solution, then a AgI fine grain emulsion with a mean grain size of 0.05 μm and of 0.283 moles, based on silver was added thereto, and solutions S-504 and X-504 were added at an accelerated flow rate (1.2 time faster at the end than at the start) for 7 min. After completing concentration in the growth stage-1, circulation of the reaction solution to the ultrafiltration unit was continuously undergone, the intergrain distance was, during the growth stage-2, linearly decreased and so controlled that the intergrain distance at the end of the growth stage-2 became 0.7 times the intergrain distance at the start of the growth stage-1.

In the above emulsion making, a maximum amount of the reaction solution within the reaction vessel was 17.1 liters. Accordingly, an emulsion of 0.83 moles, based on silver, per unit volume (l) of the reaction vessel can be prepared. Thus, a maximum of the emulsion corresponding to (0.83 mole/l)×(32 l), based on silver, can be prepared.

Preparation of Emulsion (Em-700)

Emulsion Em-700 was prepared in a manner similar to Em-500, except for the following stages.

Growth Stage-1

After completing the ripening, solutions S-502 and X-502 were added by the double jet addition at an accelerated flow rate (12 times faster at the end than at the start) for 38 min. Simultaneously with the addition of solutions S-502 and X-502, the reaction solution in the reaction vessel was circulated to an ultrafiltration unit to undergo concentration. As a result, a mean intergrain distance retained, during the addition, the intergrain distance at the start of the growth stage-1. After completing addition of solutions S-503 and X-503, the mean intergrain distance was allowed to be 0.5 times the mean intergrain distance at the start of the growth stage-1, by concentrating the reaction solution in the reaction vessel by means of the ultrafiltration unit. Further, until completing grain growth, concentration was undergone by continuously circulating the reaction solution of the reaction vessel to the ultrafiltration unit, and the mean intergrain distance was, during the growth stage, held at 0.5 times the mean intergrain distance at the start of the growth stage-1. As a result, when the dislocation lines were formed, the mean intergrain distance was 1.2 μm.

In the above emulsion making (Em-700), a maximum amount of the reaction solution within the reaction vessel was 20.3 liters. Accordingly, an emulsion of 0.70 moles, based on silver, per unit volume (l) of the reaction vessel can be prepared. Thus, a maximum of the emulsion corresponding to (0.70 mole/l)×(32 l), based on silver, can be prepared.

Preparation of Emulsion (Em-800)

Emulsion Em-800 was prepared in a manner similar to Em-600, except for the following. Thus, in the growth stage-2, after the solution temperature in the reaction vessel was lowered to 40° C., the mean intergrain distance was allowed to be 0.65 times the mean intergrain distance at the start of the growth stage-1, and was held at this value until completion of the growth. As a result, when the dislocation lines were formed, the mean intergrain distance was 1.6 μm. In the preparation of Em-800, a maximum amount of the reaction solution within the reaction vessel was 17.1 liters. Accordingly, an emulsion of 0.83 moles, based on silver, per unit volume (l) of the reaction vessel can be prepared. Thus, a maximum of the emulsion corresponding to (0.83 mole/l)×(32 l), based on silver, can be prepared.

During the course of the emulsion making described above, sampling of silver halide grains and electron microscopic observation thereof were made, and there was not observed any new grain formation during the growth stage or its growth in any one of the emulsions.

Characteristics of the emulsions are summarized as shown below. In any one of the emulsions, the mean intergrain distance at the start of grain growth was 2.4 μm, and when completing the grain growth, an average equivalent spherical diameter of silver halide grains contained in each emulsion was 0.7 μm.

TABLE 1

| Emulsion | Preparation apparatus | Range of mean intergrain distance | Coefficient of variation ESD*1 | Coefficient of variation ECD*2 | Average aspect ratio | Grain projected area Ap ≧ 5*3 | Grain projected area Ap ≧ 8*4 |
|---|---|---|---|---|---|---|---|
| Em-100 | Comp. | 1.00–1.20 | 0.26 | 0.17 | 5.4 | 72% | — |
| Em-200 | Comp. | 1.00–1.20 | 0.12 | 0.15 | 5.7 | 89% | — |
| Em-300 | Inv. | 1.00–1.06 | 0.07 | 0.09 | 5.4 | 85% | — |
| Em-400 | Inv. | 1.00–1.06 | 0.07 | 0.08 | 3.5 | 6% | — |
| Em-500 | Inv. | 1.00–1.06 | 0.09 | 0.12 | 8.9 | — | 99% |
| Em-600 | Inv. | 0.70–1.00 | 0.09 | 0.10 | 8.6 | — | 98% |
| Em-700 | Inv. | 0.50–1.00 | 0.08 | 0.09 | 2.8 | 0% | — |
| Em-800 | Inv. | 0.65–1.00 | 0.08 | 0.10 | 8.5 | — | 96% |

*1: Coefficient of variation of equivalent spherical diameter

*2: Coefficient of variation of equivalent circular diameter

*3: Percentage of the grain projected area accounted for by tabular grains having an aspect ratio of 5 or more

*4: Percentage of the grain projected area accounted for by tabular grains having an aspect ratio of 8 or more In the Table, the expression "Range of mean intergrain distance" indicates a variation range of the following ratio:

(mean intergrain distance at a time during the grain growth stage)/(mean intergrain distance at the start of the gain growth).

Preparation of Photographic Materials No. 100 to No. 800

To each of the emulsions Em-100 to Em-800 maintained at 52° C. were added sensitizing dyes SSD-1, SSD-2 and SSD-3. After ripening for 20 min., were added sodium thiosulfate, chloroauric acid and potassium thiocyanate, and each emulsion was ripened so as to ontain an optimal sensitivity-fog. When completing the ripening, 1-phenyl-5-mercaptotetrazole and 4-hydroxy-6-methyl-1,3,3a,7-tetrazaindene were added thereto for stabilization. The amounts of sensitizing dyes, sensitizers and stabilizers, and the ripening time was so designed that when exposed at 1/200 sec., an optimum sensitivity-fog relation was achieved.

To each of sensitized Emulsions Em-100 to Em-800 were added a coupler dispersion which was prepared by dissolving a coupler, MCP-1 in ethyl acetate and tricresyl phosphate and dispersing in a gelatin aqueous solution, and conventional photographic adjuvants such as a coating aid and hardener to prepare a coating solution. The thus-prepared coating solutions were each coated on a subbed cellulose triacetate film and dried according to the conventiona procedure to obtain color photographic material Samples No. 100 to No.800.

Immediately after preparation, samples were each exposed through a glass filter (Y-48, produced by Toshiba) using a light source with a color temperature of 5400° K and processed according to the following processing. In order to make evaluation with respect to pressure resitance, after each sample was allowed to stand under the conditions at 23° C. and 55% R.H. for 24 hrs., the surface of each sample was scratched with a needle with a top radius of curvature of 0.025 mm and loaded with a 5 g load, under tha same conditions using a scratch meter (product by Shitoh Kagaku) and similarly processed.

Processing

| Step | Time | Temperature | Replenishing rate |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | |

*Replenishing rate is an amount per $m^2$ of photographic material.

A color developer, bleach, fixer and stabilizer each were prepared according to the following formulas.

SSD-1

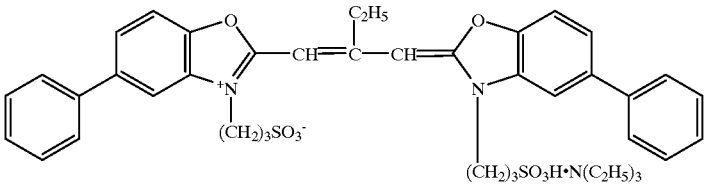

SSD-2

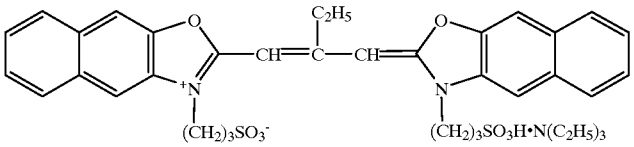

SSD-3

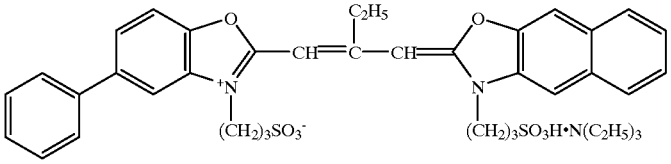

MCP-1

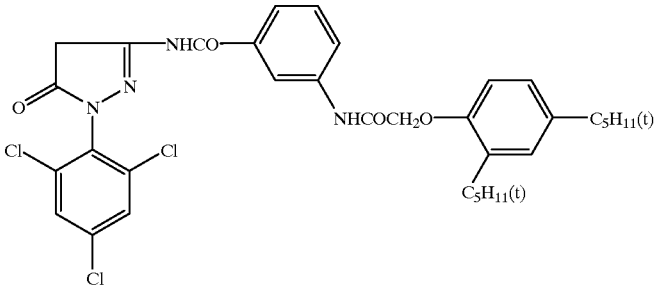

Color Developer and Replenisher Thereof

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and replenisher thereof were each adjusted to 10.06 and 10.18, respectively with potassium hydroxide and sulfuric acid.

Bleach and Replenisher Thereof

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher thereof were adjusted to 4.4 and 4.0, respectively, with ammoniacal water or glacial acetic acid.

Fixer and Replenisher Thereof

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and Replenisher Thereof

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Processed samples each were sensitometrically measured with green light, with respect to sensitivity, fog and RMS value, according to the following method and conditions. Sensitivity was represented as a reciprocal of exposure that gives a density of a minimum density (Dmin) plus 0.2 and was shown as a relative value, based on the sensitivity of Sample No.200 being 100 (i.e., a larger value means a higher sensitivity).

Fog was represented as a density at an unexposed portion (Dmin) and shown as a relative value, based on the sensitivity of Sample No.200 being 100 (i.e., a smaller value means a lower fog).

The RMS was measured at a density of a minimum density (Dmin) plus 0.1, using a microdensitometer (slit width 10 μm, slit length 180 μm) provided with a Wratten filter (W-99, produced by Eastman Kodak), in which a RMS value was represented as a standard deviation of densities of at least 1,000 samplings. The RMS was shown as a relative value, based on the RMS of Sample No.200 being 100 (i.e., a smaller RMS value means a superior graininess).

Pressure resistance was evaluated in the following manner. An increase of fog due to applied pressure (i.e., pressure fog) was represented as a density increase at an unexposed and load-applied portion and shown as a relative value (ΔDp1), based on the density increase of Sample No.200 being 100 (i.e., a smaller value means a smaller fog increase due to pressure and superior pressure resistance). A lowering of sensitivity due to applied pressure was represented as a density decrease at a load-applied portion having had a density of (Dmax−Dmin)/2 and shown as a relative value (ΔDp2), based on the density lowering of Sample No. 200 being 100 (i.e., smaller value means a smaller lowering of sensitivity due to pressure and superior pressure resistance).

Results thereof are shown in Table 2.

TABLE 2

| Sample No. | Sensitivity | Fog | RMS | Pressure resistance Δ Dp1 | Pressure resistance Δ Dp2 | Yield of emulsion |
|---|---|---|---|---|---|---|
| 100 | 93 | 138 | 112 | 106 | 99 | 102 |
| 200 | 100 | 100 | 100 | 100 | 100 | 100 |
| 300 | 108 | 96 | 92 | 95 | 96 | 146 |
| 400 | 97 | 94 | 90 | 94 | 98 | 146 |
| 500 | 116 | 95 | 91 | 90 | 93 | 146 |
| 600 | 121 | 93 | 88 | 85 | 76 | 173 |
| 700 | 99 | 97 | 95 | 96 | 96 | 146 |
| 800 | 128 | 90 | 85 | 73 | 62 | 173 |

The yield of a silver halide emulsion indicates the amount of a silver halide emulsion which can be prepared, per volume, which is shown as a relative value, based on the yield of Em-100 being 100. The moer the value, the higher the yield, thus, the manufacturing cost is improved.

Concluded from the feature of each emulsion as shown in Table 1, and photographic performance and preparation yield of each emulsion as shown in Table 2 is the following.

1) As can be seen from comparison of Sample Nos. 100 and 200, it is necessary to decrease a coefficient of variation with respect to the equivalent sphere diameter of the emulsion grains.

2) From comparison of Sample Nos. 100, 200, 300, 400 and 500, by the use of the preparation apparatus and the preparation method according to the invention, a silver halide emulsion with superior photographic performance superior can be prepared at a higher yield, as compared to silver halide emulsion prepared by conventional techniques. Further, by the use of the preparation apparatus and the preparation method according to the invention, a silver halide emulsion having a higher aspect ratio can be prepared, and thereby a silver halide emulsion with superior photographic performance can be obtained.

3) From comparison of Sample Nos. 200 and 300, or Sample Nos. 500, 60 and 700, when preparing silver halide emulsions by the use of the preparation apparatus and the preparation method according to the invention, a silver halide emulsion superior in photographic performance and improved in the manufacturing cost can be prepared by controlling the mean intergrain distance in the process of growing silver halide grains so as to be maintained within not less than 0.60 times and not more than 1.15 times that at the start of the grain growth over a period from the start of growing silver halide grains to completion thereof.

4) From comparison of Sample No. 500 with Sample Nos. 600 and 800, improvements in sensitivity and pressure resistance and an improvement in the preparation yield can be concurrently achieved by controlling the mean intergrain distance at the stage of forming dislocation lines in the process of forming silver halide grains. It is presumed that higher sensitivity and improved pressure resistance of Sample Nos. 600 and 800 are attributed to controlling the mean intergrain distance at the stage of forming the dislocation lines so as to reduce the distance, leading to enhanced efficiency of forming the dislocation lines. In fact, from transmission electron microscopic observation of the dislocation lines of these emulsion grains, it was proved that the proportion by number of grains having the dislocation lines and the number of the dislocation lines per grain had the following relationship, Em-800>Em-600>Em-500. In Em-800, particularly, the proportion of silver halide grains having 30 or more dislocation lines per grain exceeded 95% with respect to the ratio by number and the ratio of the grain projected area.

As is shown in the foregoing results, a silver halide emulsion with higher sensitivity and superior graininess and improved in manufacturing cost and with further improved pressure resistance, and preferably, a silver halide tabular grain emulsion having the above features can be prepared by the use of the preparation apparatus and the preparation method according to the invention.

EFFECT OF THE INVENTION

According to the invention can be provided an apparatus of preparing a silver halide emulsion with higher sensitivity and superior graininess and improved in manufacturing cost and further with improved pressure resistance, and preferably, a silver halide tabular grain emulsion having the above feature, and a method of preparing the emulsion.

What is claimed is:

1. A method for the preparation of a silver halide emulsion comprising introducing a silver salt and a halide into a reaction zone whereby silver halide grains are first formed and subsequently grown, said silver halide grains having a mean intergrain distance;

controlling said mean intergrain distance by ultrafiltration during silver halide grain growth so that said mean intergrain distance is 0.6 to 1.15 times the mean intergrain distance at the start of said silver halide grain growth; thereby forming a permeating solution;

introducing dislocation lines into said silver halide grains when said mean intergrain distance is 0.6 to 0.8 times the mean intergrain distance at the start of said silver halide grain growth, wherein:

$$\text{mean intergrain distance}=(\text{volume of a reaction mixture solution}/\text{number of grains in the reaction mixture solution})^{1/3}.$$

2. A method of claim 1 wherein said dislocation lines are introduced when at least 70% and not more than 90% in terms of silver amount has been introduced into the reaction zone.

3. The method of claim 1 wherein said dislocation lines are introduced when the mean intergrain distance is not more than 3.2 $\mu$m.

4. The method of claim 3 wherein said dislocation lines are introduced when the mean intergrain distance is between 0.9 $\mu$m and 2.0 $\mu$m.

5. The method of claim 1 comprising returning a portion of said permeating solution to the reaction zone.

6. The method of claim 1 wherein said ultrafiltration runs continuously at least until completion of grain formation.

7. The method of claim 1 wherein said silver salt and said halide are introduced substantially at a bottom of the reaction zone.

8. The method of claim 1 wherein said mean intergrain distance in said reaction zone is controlled by controlling at least one of dispersing medium introduction, water introduction, and draining said permeation solution.

9. The method of claim 8 comprising returning a portion of a said permeating solution to said reaction zone.

10. The method of claim 9 comprising controlling a permeation flow of said permeating solution.

11. The method of claim 1 wherein said mean intergrain distance is controlled by controlling at least three of said introduction of a silver salt, said introduction of a halide, introduction of a dispersing medium, introduction of water, returning of a portion of said permeating solution to said reaction zone, and draining from said reaction zone, by varying flow rates.

* * * * *